United States Patent [19]

Loewenthal

[11] 4,316,354

[45] * Feb. 23, 1982

[54] APPARATUS FOR GROUPING AND INSERTING OBJECTS INTO CONTAINERS

[75] Inventor: Horst Loewenthal, Tiengen, Fed. Rep. of Germany

[73] Assignee: SIG-Schweizerische Industrie-Gesellschaft, Neuhausen am Rheinfall, Switzerland

[ * ] Notice: The portion of the term of this patent subsequent to Mar. 3, 1998, has been disclaimed.

[21] Appl. No.: 19,604

[22] Filed: Mar. 12, 1979

[30] Foreign Application Priority Data

Mar. 15, 1978 [CH] Switzerland ..... 2831/78

[51] Int. Cl.[3] ..... B65B 35/16; B65B 35/44

[52] U.S. Cl. ..... 53/538; 53/171; 53/247

[58] Field of Search ..... 53/537, 538, 539, 244, 53/247, 248, 171; 294/116; 414/69

[56] References Cited

U.S. PATENT DOCUMENTS

| | | | |
|---|---|---|---|
| 2,697,541 | 12/1954 | Patterson | 53/171 X |
| 2,760,316 | 8/1956 | Okolitch et al. | 53/539 X |
| 2,815,623 | 12/1957 | Holstebroe et al. | 53/538 X |
| 3,029,100 | 4/1962 | Laine | 294/116 |
| 3,082,584 | 3/1963 | Schmidt | 53/171 X |
| 3,179,460 | 4/1965 | Gunzelmann | 294/116 X |
| 3,269,086 | 8/1966 | Cloots | 198/425 |
| 3,410,046 | 11/1968 | Johnson | 53/247 X |
| 3,455,085 | 7/1969 | McIntyre | 53/537 X |
| 3,550,754 | 12/1970 | Ganz | 198/425 |
| 3,601,951 | 8/1971 | Bargel | 53/247 |
| 3,630,391 | 12/1971 | Wilson | 294/116 X |
| 3,631,651 | 1/1972 | Kopp | 53/247 |
| 3,648,427 | 3/1972 | Raudat et al. | 53/539 X |

FOREIGN PATENT DOCUMENTS

| | | | |
|---|---|---|---|
| 2145339 | 3/1973 | Fed. Rep. of Germany | 198/425 |

*Primary Examiner*—John Sipos

*Attorney, Agent, or Firm*—Spencer & Kaye

[57] ABSTRACT

Apparatus for forming objects into groups and inserting successive groups into containers, which includes a grouping station, an individual item conveyor for guiding the objects individually to the grouping station, a group conveyor for conveying the objects in groups away from the grouping station, a container conveyor for conveying successive containers relative to the group conveyor, and a mechanism for inserting groups of objects conveyed by the group conveyor into successive containers, and in which the item conveyor and the group conveyor convey the objects at least approximately in the same direction into the inserting mechanism, and the inserting mechanism includes a vertically movable holding device movable between an upper position in which it holds a group of objects and a lowered position at which it can release such group of objects within an open container which has been brought into position by the container conveyor.

6 Claims, 8 Drawing Figures

APPARATUS FOR GROUPING AND INSERTING OBJECTS INTO CONTAINERS

BACKGROUND OF THE INVENTION

The present invention relates to an apparatus for forming objects into groups and then inserting successive groups into containers, such as boxes.

An apparatus of this type is described, for example, in German Auslegeschrift [Published Patent Application] No. 2,240,541. In this apparatus, a group of packages is placed into a container by a group conveyor defining a long, complicated path subject to malfunction. In addition to the drawback of complicated stucture, there exists the major drawback that high outputs can not be achieved.

SUMMARY OF THE INVENTION

It is an object of the present invention to eliminate, or at least substantially reduce, these drawbacks.

This and other objects of the invention are achieved, in apparatus for forming objects into groups and inserting successive groups into containers, which includes a grouping station, an individual item conveyor for guiding the objects individually to the grouping station, a group conveyor for conveying the objects in groups away from the grouping station, a container conveyor for conveying successive containers relative to the group conveyor, and means for inserting groups of objects conveyed by the group conveyor into successive containers, by arranging the item conveyor and the group conveyor so that they convey the objects at least approximately in the same direction into the means for inserting, and by constituting the means for inserting of vertically movable holding means movable between an upper position in which they hold a group of objects and a lowered position at which they can release such group of objects within an open container which has been brought into position by said container conveyor.

An advantage of apparatus according to the invention is that it causes the grouped objects to enter the insertion device without a change in their direction of movement and places them into a container, which is in a filling position, simply by holding means which can be moved up and down. It is here of particular advantage to move the holding means, in their effective position, only in a downward direction and to lower these holding means to several levels to permit placing groups of objects on top of one another in the container.

The objects to be placed into a container are usually elongate and flat and may consist, for example, of so-called "finned packages", i.e. packages containing individual pieces and closed at their ends by welded or sealed seams which protrude in the form of fins. If such finned packages are to be placed into containers, it is of great advantage to use, as the holding means, clamping jaws, which in their effective position clamp in the upwardly folded fins of the packages.

The grouping station is preferably formed of the end regions of parallel supports on which the packages are advanced by the individual item conveyor.

In a preferred embodiment of the invention, the container conveyor is provided with grippers which are fastened to endless chains that advance the containers in a stepwise manner onto a table, the spacing between opposite faces of each gripper being equal to or slightly less than the desired spacing between successive containers. This permits very accurate positioning of the container to be filled.

Embodiments can be constructed according to the invention which permit a container to be filled with a plurality of layers of package groups with each layer being formed of two juxtaposed groups.

The holding means need not necessarily be clamping jaws. If objects other than finned packages are to be introduced, the holding means may also be, for example, suction cups that are moved up and down in which a vacuum is generated when they are in their upper position and switched off after they are lowered.

DESCRIPTION OF THE PREFERRED EMBODIMENTS

Figure 1:
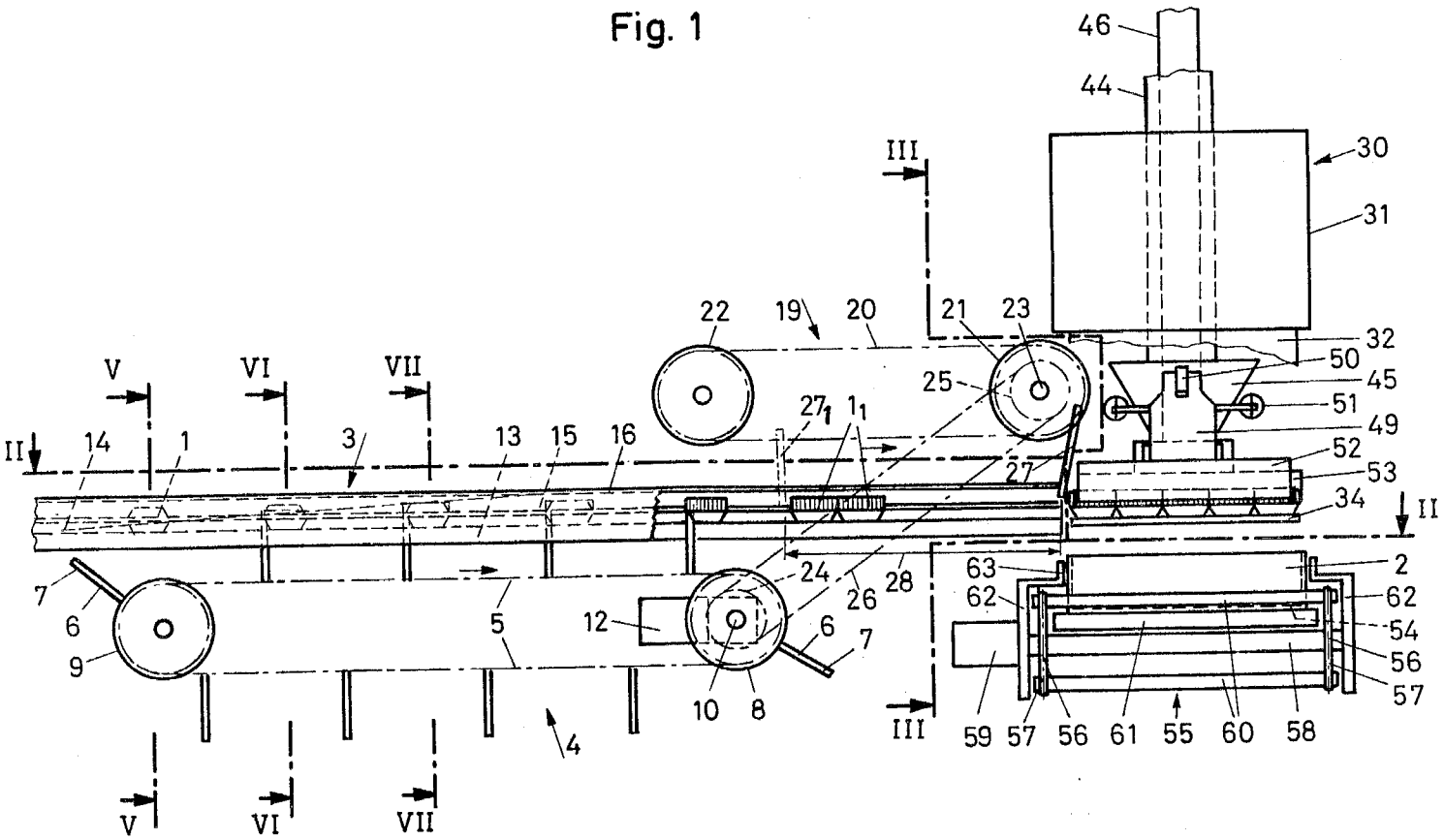
FIG. 1 is a side elevational view of a preferred embodiment of a grouping and inserting device according to the invention for finned packages, with parts of the device being broken away.

The illustrated apparatus is provided for the purpose of placing packages 1 into cardboard boxes 2 which are open at the top. The packages 1 travel on a feeding conveyor 3 into the effective range of an individual item conveyor 4 which essentially includes two endless chains 5 provided in pairs with pushers 7 that are connected together by flat cross pieces 6. The chains 5 are guided by means of drive wheels 8 and deflection wheels 9. The drive wheels 8 are mounted on a shaft 10 driven via gears 11 by a motor 12.

Figure 5:
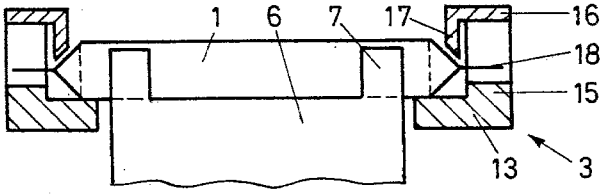
FIG. 5 is a cross-sectional view along line V—V of FIG. 1 and to a larger scale.
Figure 6:
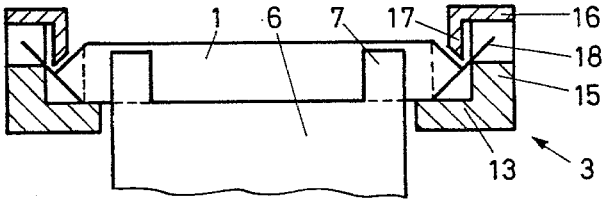
FIG. 6 is a cross-sectional view along line VI—VI of FIG. 1 and to a larger scale.
Figure 7:
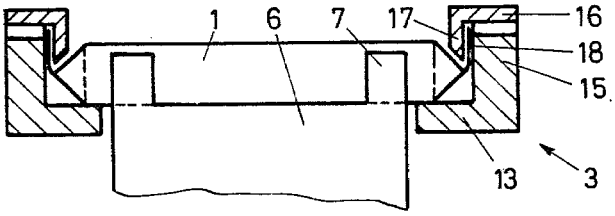
FIG. 7 is a cross-sectional view along line VII—VII of FIG. 1 and to a larger scale.

The feeding conveyor 3 is provided with two parallel lower supports 13, shown particularly in FIGS. 5–7, which beginning at a starting point 14, are each provided with a linearly rising lateral folding guide 15. Conveyor 3 is further provided with two upper strips 16 having an angular cross section and connected at their longitudinal ends with lateral guides 15. Each strip 16 has a downwardly extending inner arm 17.

The ends of the finned packages 1 rest on the lower supports 13 with their inverted-pleat fins 18 formed by welded or sealed seams, lying at the start of the individual item conveyor 4, above the fold guides 15 as shown in FIG. 5. If now the packages 1 are individually advanced by pushers 7, the rising guides 15 fold the fins 18 upwardly so that they are pushed into position shown in FIG. 6 and finally, as shown in FIG. 7, against the inner arms 17 of the upper strips 16.

Figure 2:
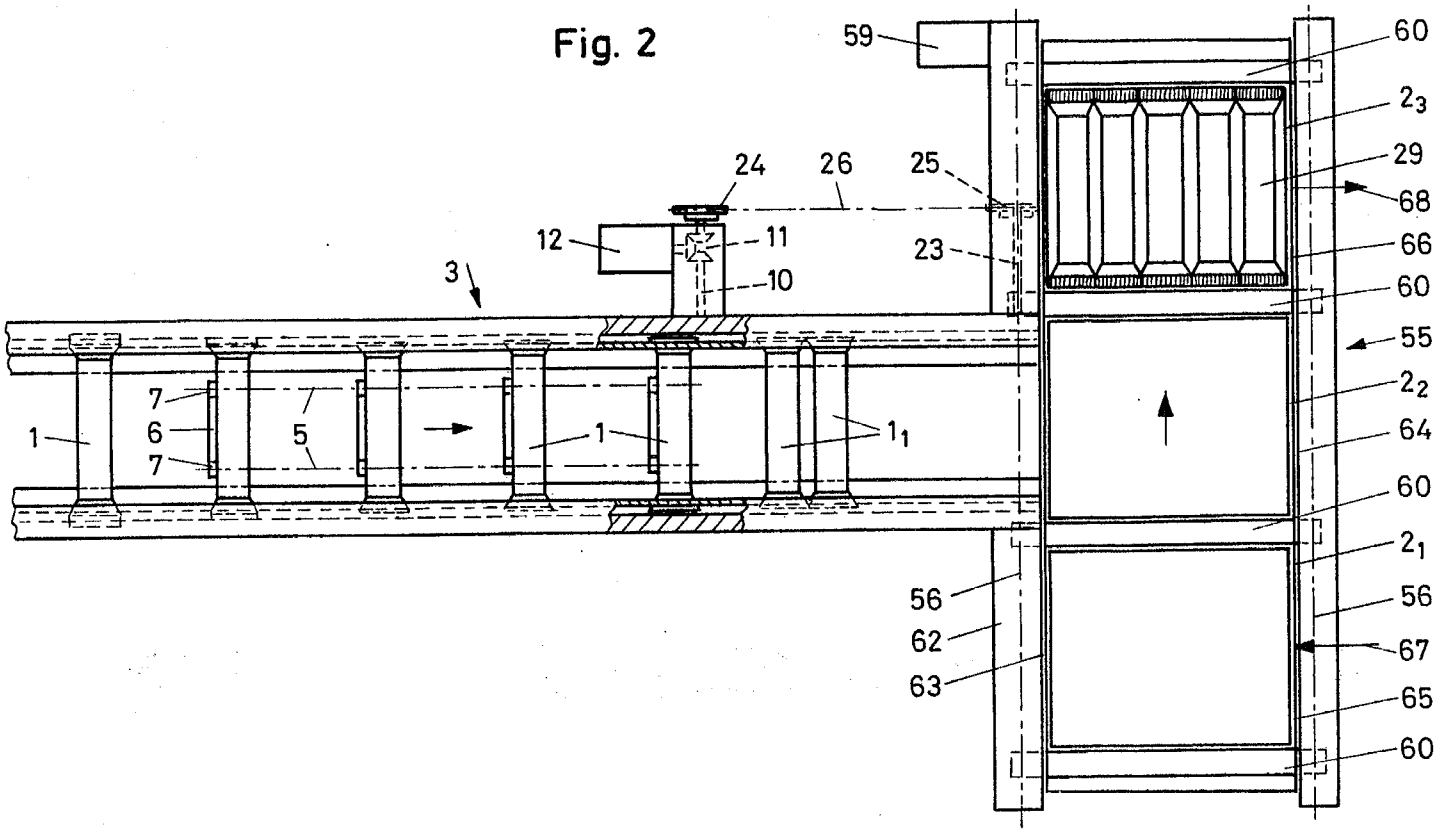
FIG. 2 is a partial top plan view of the embodiment of FIG. 1 taken along the line II—II of FIGS. 1 and 3.

At the end of the individual item conveyor 4, the packages 1 arrive at a group conveyor 19 which has two parallel, endless chains 20 moving around drive wheels 21 and deflection wheels 22. The shaft 23 of wheels 21 is driven by motor 12 via gears 11 (FIG. 2)

and an endless chain 26 running on sprocket wheels 24 and 25. Chains 20 are equipped with pushers 27, only one of which is shown in solid lines, namely at the downstream end of the supports 13 which, like the upper strips $16_1$, extend below chains 20 into a grouping region 28. Region 28 constitutes a collection station where packages $1_1$ are no longer propelled by the pushers 7 of the individual item conveyor 4.

At the instant depicted in FIG. 1, two packages $1_1$ have already reached the grouping region 28. After three more packages are advanced in succession into this region 28 by pushers 7, the latter region is filled and then pusher 27 becomes effective at the position $27_1$ shown in dot-dash lines to bring the resulting group 29 (FIG. 2) of five packages toward an insertion device which then places them into an empty box 2 disposed therebelow.

The pushers 27 are pivotally mounted on chains 20 in a known manner and are controlled so that their angle of inclination with respect to the chains changes in such a way that, on the one hand, they can become effective at the beginning of the region 28 and, on the other hand, they do not hit the insertion device 30.

Figure 3:
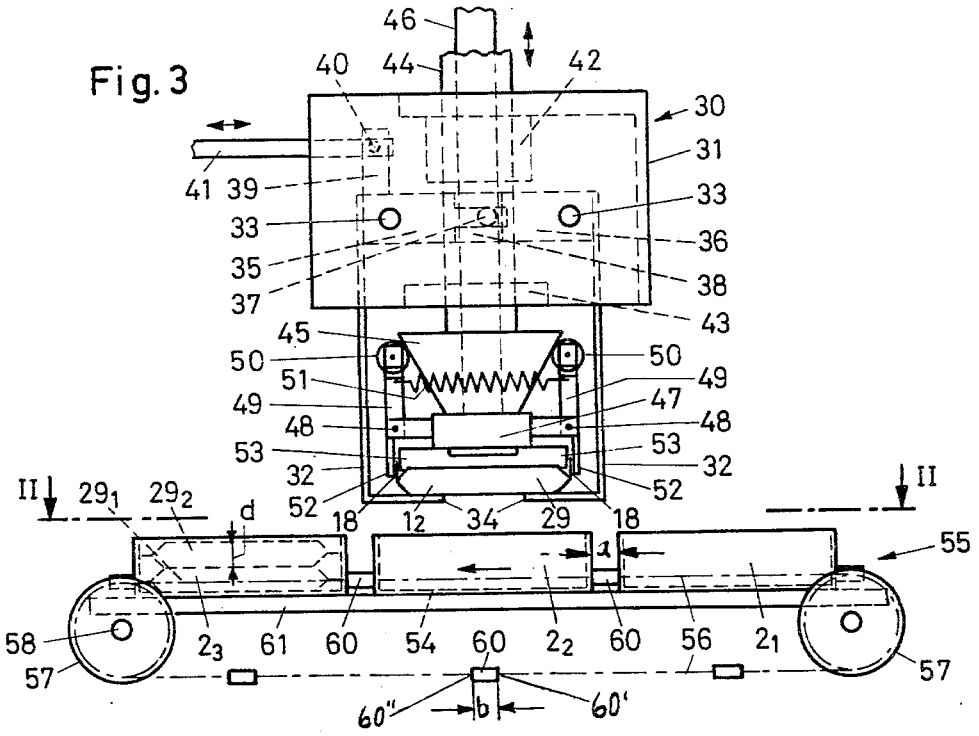
FIG. 3 is an elevational view along the line III—III of FIG. 1.
Figure 4:
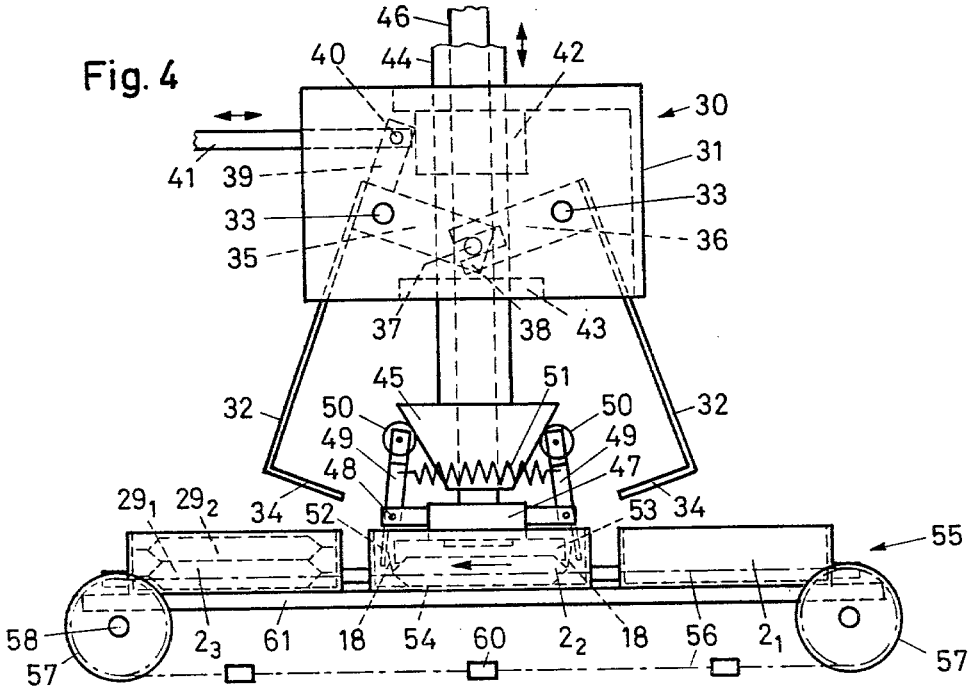
FIG. 4 is the same view as FIG. 3, but with the parts in a different operating phase.

The insertion device 30 is provided with a frame portion 31 at which, as shown in FIGS. 3 and 4, two downwardly oriented, oppositely rotatable pivot arms 32 are pivotally mounted at respective axes 33. The pivot arms 32 are provided at their lower ends with inwardly oriented supporting members 34 for the ends of packages $1_2$ of a group 29. When a group 29 is advanced by group conveyor 19, the pivot arms 32 are in their inward position as shown in FIG. 3 so that a group 29 moves from the grouping region 28 onto the supporting members 34, which are disposed at the same height as the supports 13.

In order to be able to pivot the arms 32 outwardly, these arms are provided at their tops with respective inwardly protruding extensions 35 and 36. The extension 35 is provided with a pin 37 enclosed by a fork 38 of extension 36. The extension 35 is also in communication with an actuation rod 41 via a protrusion 39 and a journal pin 40. It can be seen that displacement of rod 41 causes the arms 32 to alternatingly take on the supporting position shown in FIG. 3 and the releasing position shown in FIG. 4.

The frame portion 31 is provided with a guide 42 and 43 for a vertical tube 44 which can be moved up and down and whose lower end is connected to a downwardly tapering conical control head 45. A vertical rod 46 is disposed in tube 44 and is likewise displaceable up and down independently of tube 44. A supporting element 47 is fastened to the lower end of rod 46. Two oppositely pivotal arms 49 are journaled to the supporting body 47 at respective axes 48 and are provided at their top ends with follower rollers 50 which are kept in contact with control head 45 by means of two tension springs 51 fastened between arms 49. Arms 49 are extended at the bottom by elastic, outer clamping jaws 52 which cooperate with rigid inner clamping, or counter, jaws 53 fastened to supporting element 47. The clamping jaws 52 and 53 extend in the longitudinal direction of the group 29, i.e. perpendicular to the plane of FIGS. 3 and 4, over its entire length.

In the feeding position, i.e. when a group 29 is being pushed onto the supporting elements 34 by means of a pusher 27 of group conveyor 19, the supporting members 34 are in the position shown in FIG. 3. The control head 45, however, is not quite in the position shown in FIG. 3 so that the upwardly directed fins 18 can still pass between each pair of clamping jaws 52 and 53. As soon as the group 29 has been pushed completely into the insertion device 30, head 45 is lowered completely so as to cause the fins to be clamped in between the clamping jaws 52, 53. Now the pivot arms 32 are spread apart by movement of actuating rod 41 and the tube 44 together with rod 46 is lowered so that the group 29 comes to rest on the bottom 54 of the box $2_2$.

Thereafter, first the control head 45 is pulled upwardly so that the outer clamping jaws 52 can be pivoted outwardly as shown in FIG. 4 and release the fins 18. If now the supporting body 47 is also pulled upwardly in order to reestablish the filling position, the group 29 comes to rest on the bottom 54 of the container $2_2$.

Then the same sequence is repeated with the difference that the jaws 52 and 53 are lowered to a point which is less deep by the thickness d (FIG. 3) of the packages 1 before the fins 18 are released, so that the second group $29_2$ comes to rest on top of group $29_1$, as shown in the filled box $2_3$ of FIG. 3.

An embodiment of insertion device 30 is disclosed in my U.S. Application Serial No. 19,606, filed on the same date of the present application, for APPARATUS FOR INSERTING FINNED PACKAGES INTO CONTAINERS now U.S. Pat. No. 4,253,293, and claiming priority of Switzerland Application No. 2 832/78-4 of Mar. 15th, 1978.

The boxes 2 are then transported in stages by a container conveyor 55, one of the boxes always being in the fill position $2_2$. For this purpose, the conveyor 55 is provided with two parallel, endless chains 56 which are guided by means of sprocket wheels 57. The shaft 58 of two of the wheels 57 is driven intermittently by a driving motor 59 (FIGS. 1 and 2). The chains 56 are equipped with transversal gripper rods 60 which advance the boxes 2 on a support table 61.

Each rod 60 is provided with opposite gripper faces 60' and 60'' spaced apart by a distance b which is equal to or only slightly less than the desired spacing a between boxes 2 so that the boxes can be positioned between the grippers with only a little play.

Container conveyor 55 further includes frame portions 62 which present two guides 63 and 64 that are not shown in FIGS. 3 and 4 but can be seen in FIGS. 1 and 2. The guide 64 has two gaps 65 and 66 at which empty boxes $2_1$ can be fed in in the direction of the arrow 67 and filled boxes $2_3$ can be moved away in the direction of the arrow 68, respectively. The feed-in and removal means are of conventional type, for example gripper chains disposed above the level of table 61.

Figure 8:
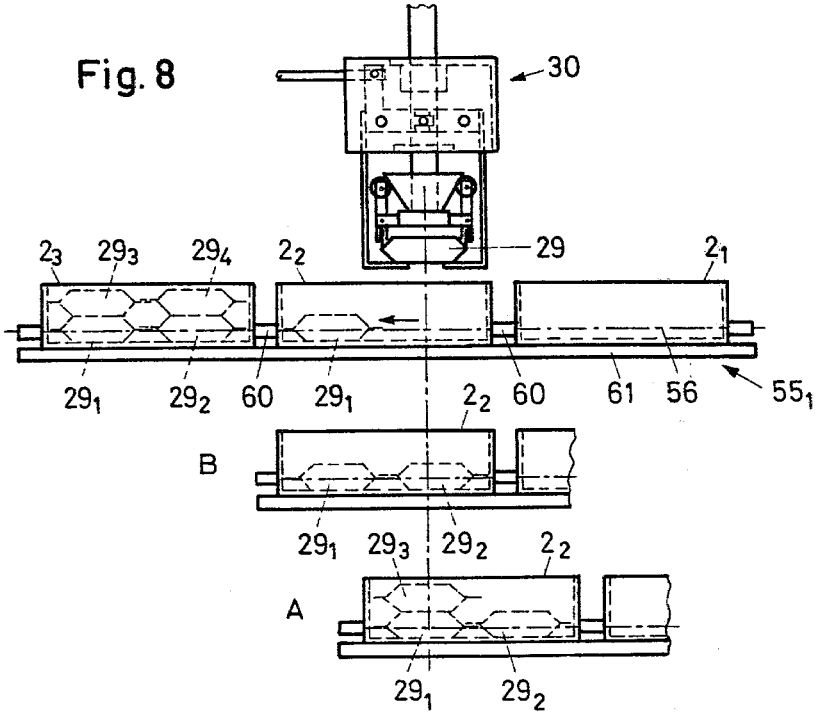
FIG. 8 is a simplified partial view corresponding to FIG. 3, depicting various operating stages of one operating mode according to the invention.

The grouping and insertion device shown in FIG. 8 differs from the above-described apparatus essentially by the mode of operation of the container conveyor $55_1$ disposed below the insertion device 30. The container conveyor is designed in the same manner as the conveyor 55, but its drive motor 59 is now of such design and is so controlled that the chains 56 provided with grippers 60 advance in steps which successively place the boxes into two fill positions A and B. In position A, one group $29_1$ is placed into the foremost half of the box $2_2$; then the box is advanced longitudinally into position B by one step equal to the width of one group of packages and a group $29_2$ is inserted into the rearmost half of the box. Then the chains 56 move backward by a "group step" of the same magnitude into position A whereupon a group $29_3$ is placed on top of group $29_1$.

After a further group step forward into position B, group $29_4$ is finally placed onto group $29_2$, thus filling box $2_2$. Now box $2_2$ is advanced by a distance equal to the sum of the width of a group 29 and the desired spacing a between containers 2, or by a "container step" so that the box $2_2$ comes into the position of box $2_3$ which had previously been removed toward the side from the position illustrated in FIG. 8. At the same time an empty box $2_1$ goes into the position of box $2_2$ at location A, where a new filling cycle begins.

It is clear that additional group steps forward and backward would permit two further groups to be placed into box $2_2$, and the insertion devices would then of course have to be designed and controlled so that they lower the groups 29 successively to more than two different levels.

The described grouping and inserting devices produce a substantially greater output than prior art devices, in particular they can place up to more than 200 packages per minute into the boxes and this with reduced driving expenses and greater dependability.

It will be appreciated that the mechanism for driving the container conveyor in the desired stepwise sequence and for moving rods 41 and 46 and tube 44 in the desired sequence can be constructed in a straightforward manner on the basis of principles already well known in the kinematic linkage art.

It will be understood that the above description of the present invention is suceptible to various modifications, changes and adaptations, and the same are intended to be comprehended within the meaning and range of equivalents of the appended claims.

What is claimed is:

1. In apparatus for forming flat objects into groups and inserting successive groups into containers, which includes a grouping station, an individual item conveyor for guiding the objects individually to the grouping station, a group conveyor for conveying the objects in groups away from the grouping station, a container conveyor for conveying successive containers relative to the group conveyor, and means for inserting groups of objects conveyed by the group conveyor into successive containers, the improvement wherein: said item conveyor and said group conveyor are arranged to convey the objects substantially horizontally and at least approximately in the same direction into said means for inserting; said means for inserting comprise vertically movable holding means movable between an upper position in which they hold a group of objects and a lowered position at which they can release such group of objects within an open container which has been brought into position by said container conveyor; said item conveyor comprises at least one endless chain, a plurality of pushers attached to said chain for pushing the objects and support means for supporting the objects as they are being conveyed; said grouping station is formed by the end region of said support means; said group conveyor comprises at least one endless chain and a plurality of pushers attached to said chain and each operative for bringing one respective group of objects to said holding means when said holding means are in their upper position; each object is finned package having two fins each extending from a respective opposite end of the package; said apparatus further comprises means for causing the fins of each package to be in an upwardly folded position in the region of said inserting means; and said holding means comprise two sets of clamping jaws operable between a gripping state in which they grip a group of packages with one set of jaws clamping in one upwardly folded fin of each package of the group and the other set of jaws clamping in the other upwardly folded fin of each package of the group, and a releasing state in which said sets of jaws release such group, with said clamping jaws being operated to move only downwardly when in their gripping state, to move only upwardly when in their releasing state, and to be movable to a selected one of several lowered positions having respectively different levels.

2. Apparatus as defined in claim 1 wherein each set of clamping jaws comprises a fixed jaw and a movable jaw, and said means for inserting further comprise a tube mounted to be moved vertically, a rod guided in said tube for vertical movement independently of said tube, a supporting body carried by said rod and carrying said fixed jaws, a pair of arms pivotally mounted on said supporting body and each carrying a respective one of said movable jaws, and a control head mounted to the lower end of said tube and operatively associated with said arms for pivoting said arms in mutually opposite directions between a position in which said jaws are in the gripping state and a position in which said jaws are in their releasing state, upon movement of said tube relative to said rod.

3. An arrangement as defined in claim 1 wherein said means for inserting further comprise a pair of movable supporting members movable toward one another into a position for supporting the ends of a group of objects received from said group conveyor when said holding means is in its upper position, and away from one another into a position clear of the group of objects during lowering of said holding means.

4. An arrangement as defined in claim 1 wherein each finned package has a welding seam defining the fin at each end, and said support means comprise, in the region of said item conveyor, lateral, ascending fold guides arranged to fold the fins of each finned package upwardly, and an upper strip associated with each fold guide and presenting a downwardly protruding arm against which a respective fin is pressed by said associated fold guide.

5. An arrangement as defined in claim 1 wherein said container conveyor comprises a table for supporting a succession of containers, at least one endless chain extending along said tables, and a plurality of gripper members fastened to said chain, said chain being driven to advance containers along said table, and each said gripper member presenting opposed faces spaced apart in the conveying direction by a distance equal to or slightly less than the desired spacing between successive containers.

6. An arrangement as defined in claim 5 wherein each container is dimensioned to hold a plurality of groups of objects adjacent one another at the same level, said container conveyor is arranged to be driven in a manner to bring a given container into either selected one of two different fill positions underneath said holding means in a sequence including, in order, movement in a forward direction through a distance equal to the spacing between successive containers to a first fill position, movement in the forward direction through a distance equal to the interval between groups of objects at the same level in a container into a second fill position, and movement in the opposite direction back to the first fill position, and said holding means are arranged to release a group of objects when a container is in each fill position, at a level which corresponds to the current fill state of the container at that fill position.

* * * * *